US005305481A

United States Patent [19]

Nebb

[11] Patent Number: 5,305,481

[45] Date of Patent: Apr. 26, 1994

[54] MOBILE SALON STATION

[75] Inventor: J. Clyde Nebb, Walbridge, Ohio

[73] Assignee: Mobile Salon Station, Inc., Toledo, Ohio

[21] Appl. No.: 910,558

[22] Filed: Jul. 8, 1992

[51] Int. Cl.[5] ..... A45D 19/04; A45D 19/12

[52] U.S. Cl. ..... 4/516; 4/518; 4/519; 4/644; 4/645

[58] Field of Search ..... 4/515-519, 4/523, 553, 554, 621, 625, 626, 627, 644, 645, 646

[56] References Cited

U.S. PATENT DOCUMENTS

| | | | |
|---|---|---|---|
| 1,855,864 | 4/1932 | Mjaaland et al. | 4/644 |
| 2,532,706 | 12/1950 | Freund | 4/644 X |
| 2,760,207 | 8/1956 | Glintz | 4/516 |
| 3,465,370 | 9/1969 | Chernick | 4/515 |
| 3,594,830 | 7/1971 | Clifton | 4/625 |
| 3,697,127 | 10/1972 | Robertson | 4/523 X |
| 4,660,233 | 4/1987 | Beaver | 4/516 |

FOREIGN PATENT DOCUMENTS

| | | | |
|---|---|---|---|
| 1309939 | 10/1962 | France | 4/516 |

*Primary Examiner*—Henry J. Recla
*Assistant Examiner*—Robert M. Fetsuga
*Attorney, Agent, or Firm*—Allen D. Gutchess, Jr.

[57] ABSTRACT

A mobile salon station comprises a cart having two generally upright frame members which are vertically adjustable. The cart further has wheels and feet and two horizontal shelves. Two supporting rods are mounted on the frame members and support a basin having tubes received on the rods. The basin can be removed from the rods so that the salon station can be used with the basin supported on the rods for a patient in a wheelchair and can be removed and used on a bed for a bedridden patient. The basin has a convex central portion so that the patient's head can be supported thereon while the hair is being shampooed, etc. The rods are pivotally mounted so as to be swung into the plane of the upright frame members when the station is being transported.

13 Claims, 3 Drawing Sheets

MOBILE SALON STATION

This invention relates to a mobile salon station.

The salon station in accordance with the invention is highly portable, light in weight, and can be manipulated by a person with one hand. It can be carried easily in a car and transported to any location where an individual is restricted to a residence. It can be readily wheeled up steps or ramps and employed in any room of a home. An invalid can receive complete salon service, whether bedridden or in a wheelchair.

Portable shampooing stands of various types have been known in the art, as shown in U.S. Pat. No. De. 195,396; U.S. Pat. Nos. 1,244,535; 2,850,742; 3,523,306; 3,579,656; 4,081,867; 4,821,347; and 4,998,302. These stands have lacked a high degree of portability, versatility, adaptability to various surroundings, and/or other deficiences.

More specifically, the mobile salon station according to the invention includes a cart having wheels, feet, two vertically adjustable frame members terminating in an upper handle, and two shelves. The lower shelf holds two containers or bottles, one being for fresh water and one for used water. Upper portions of the two vertical frame members are vertically adjustable relative to lower portions. The upper portions pivotally mount two supporting rods which can extend outwardly from the frame members or pivot inwardly to be in the same plane as the frame members when the unit is transported. A basin or bowl has two tubes at edges thereof received on the supporting rods when the station is to be used behind a wheelchair, for example, with the basin vertically adjusted to receive an invalid's head when the invalid is sitting in the wheelchair.

The basin can also be readily removed from the supporting rods and used under the head of a bedridden invalid. The bottom of the basin has an upwardly-facing convex central portion on which the invalid's head can rest, with water draining down around the edges of the basin and out a drain fitting at the back where, by hose, it is drained into the used water container. With the head supported, pressure is relieved from the neck and there is no need to place the person in an awkward, semi-inclined position.

When the station is transported, two supply cases can be supported on the two shelves. One supply case contains a pump, preferably operated by a foot switch, a hose with a funnel for filling the fresh water container and connecting hoses for the drain, pump, shampoo spray, etc. The other supply case contains the usual supplies for shampooing, conditioning, and rinsing the hair.

It is, therefore, a principal object of the invention to provide a highly portable salon station, designed particularly for invalids confined at home, and having the advantages discussed above.

Many other objects and advantages of the invention will be apparent from the following detailed description of a preferred embodiment thereof, reference being made to the accompanying drawings, in which.

Figure 1:
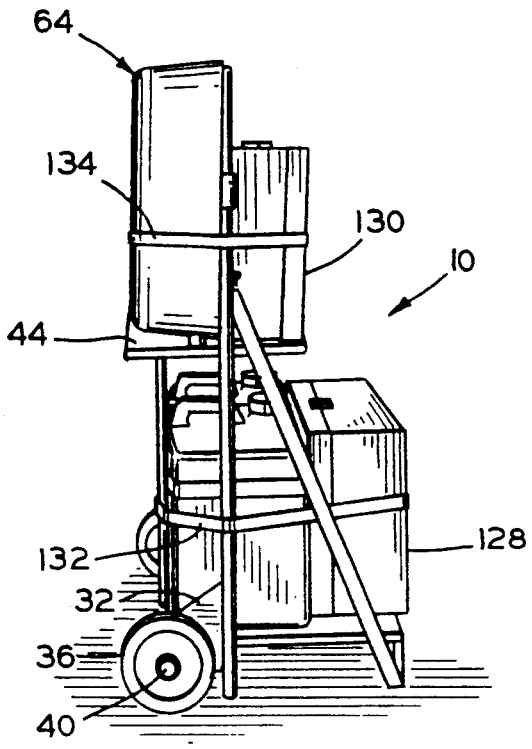
FIG. 1 is a side view in perspective of the mobile salon station according to the invention in a condition to be transported.
Figure 2:
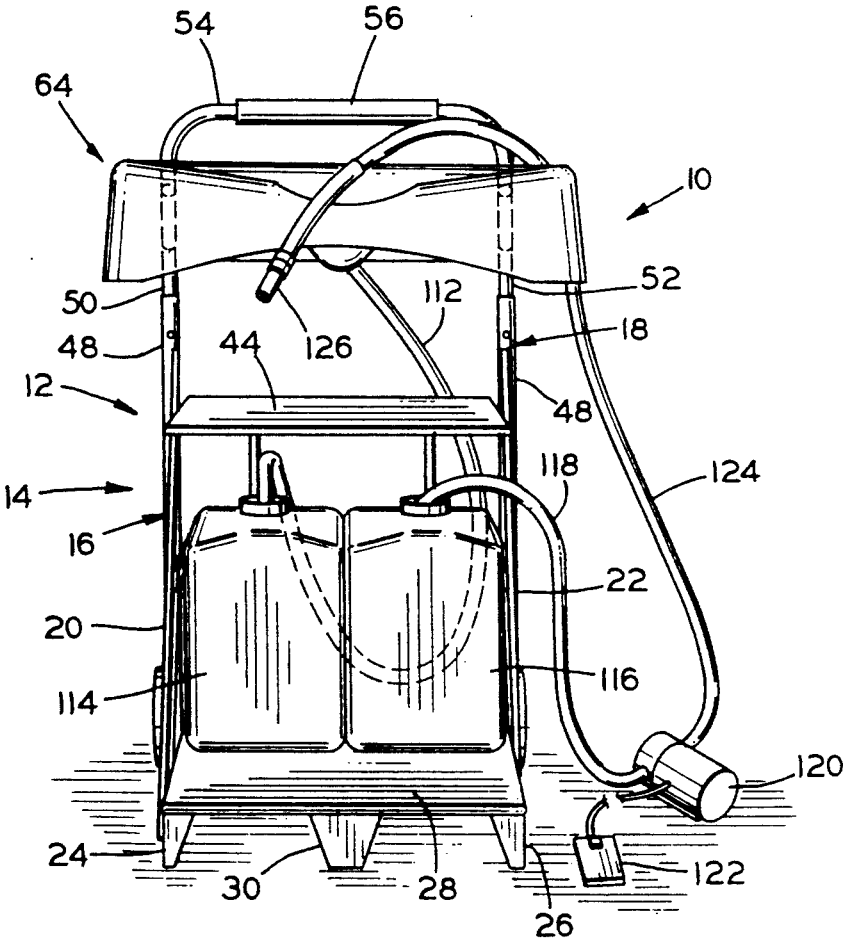
FIG. 2 is a front view in perspective of the salon station in an operating condition.
Figure 3:
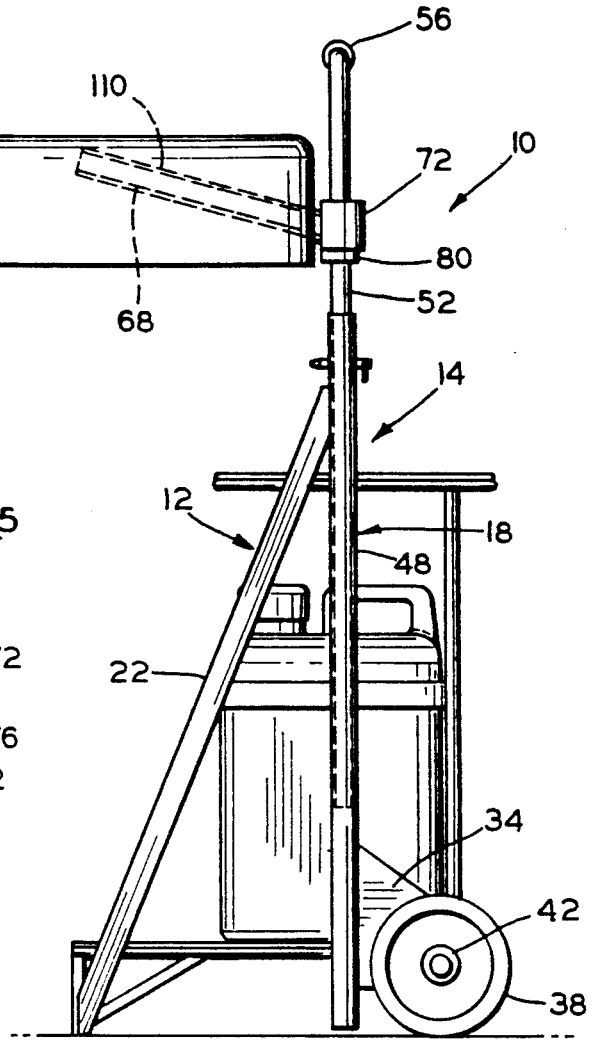
FIG. 3 is a side view in elevation of the salon station in the operating condition.

Referring to the drawings, and more particularly to FIGS. 1-3, a mobile salon station according to the invention is indicated at 10. It includes an upright cart 12 having a frame indicated at 14 and comprising two upright frame members 16 and 18 and diagonal supporting struts 20 and 22. The struts 20 and 22 are affixed to the frame members 16 and 18 and to outer lower feet 24 and 26 extending downwardly from a lower shelf 28. A central foot 30 also extends down from the shelf for additional stability. The back edge of the shelf 28 is supported by gussets 32 and 34 which are also affixed to lower end portions of the upright frame members 16 and 18. Wheels 36 and 38 are rotatably supported by the gussets 32 and 34 through stub shafts 40 and 42. The wide spacing of the wheels 36 and 38 and the feet 24, 26, and 30 provides a wide, stable supporting base for the mobile salon station.

An upper shelf 44 is parallel to and somewhat smaller than the lower shelf 28 and is affixed to and supported by the upright frame members 16 and 18 and the struts 20 and 22. The upper shelf 44 also contributes stability to the overall cart 12.

Figure 4:
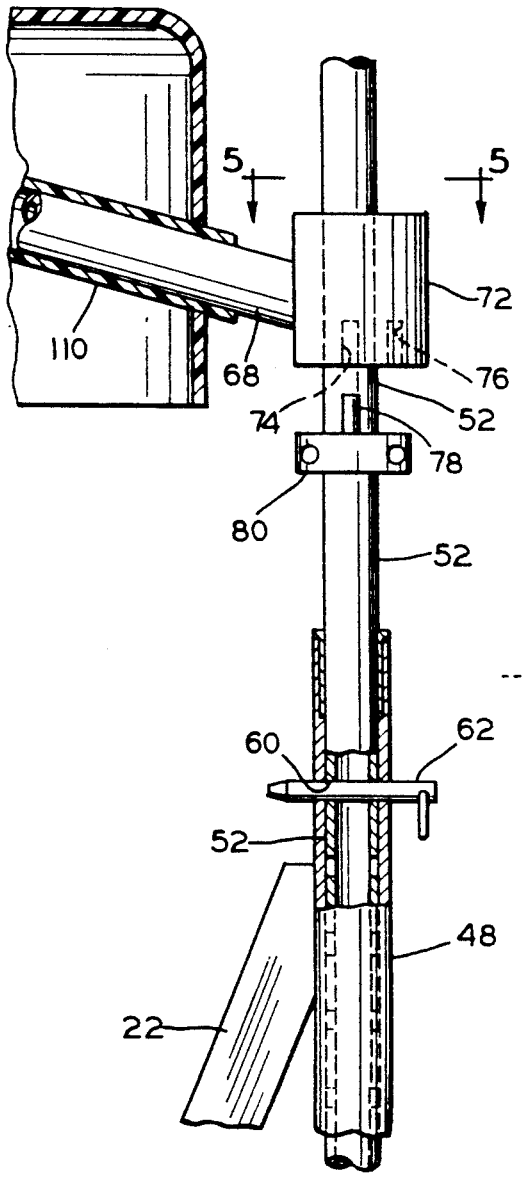
FIG. 4 is an enlarged, fragmentary view of a vertical frame member of the salon station along with certain components thereof.

Each of the upright frame members 16 and 18 include stationary or fixed lower portions 46 and 48 and vertically adjustable upper portions 50 and 52. The upper portions 50 and 52 are connected by a handle 54 with a pad 56. As shown in FIG. 4, each of the upper portions 50 and 52 has a plurality of aligned holes 58 spaced at one inch increments therein. Each of the lower stationary portions 46 and 48 of the upright frame members has a single set of aligned holes 60. The adjustable portions 50 and 52 can be raised and lowered by one-inch increments and then held in position by insertion of a retaining pin 62. In a preferred form, the upper portions 50 and 52 of the upright frame members 16 and 18 can be adjusted so that the upper edge of a basin or bowl 64 is from about thirty-eight to about forty-eight inches above the floor. This enables the station to be adaptable to various sizes and heights of wheelchairs and patients therein.

Figure 5:
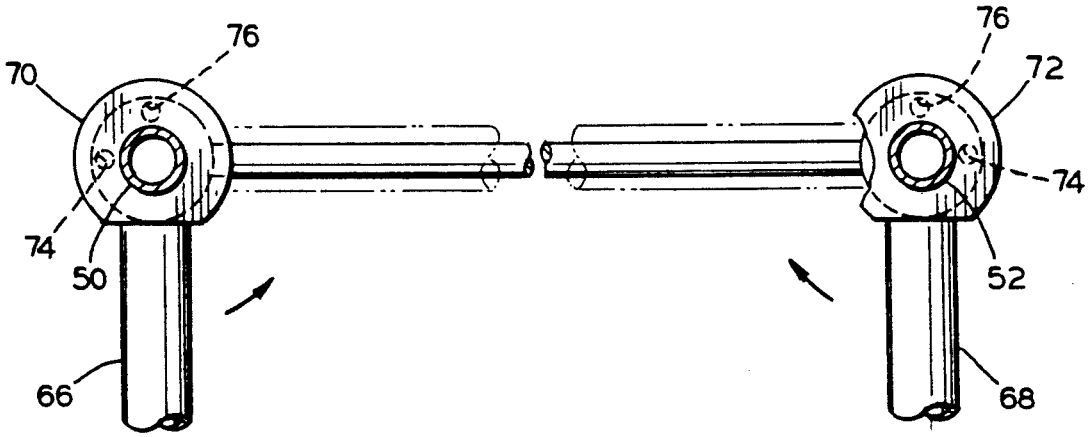
FIG. 5 is a fragmentary sectional view, taken along the line 5—5 of FIG. 4, of the vertical frame members and showing basin supports in extended and folded conditions, the latter being in dotted lines.

Referring to FIGS. 3-5, the basin 64 is removably supported on supporting rods 66 and 68. These extend at approximately a fifteen degree angle above the horizontal and are suitably affixed to hubs or cylinders 70 and 72. The hubs are rotatably and slidably mounted on the vertically adjustable upper portions 50 and 52 of the upright frame members 16 and 18. Each of the lower annular edges of the hubs have recesses 74 and 76 which receive pins 78 (FIG. 4). The pins 78 extend upwardly from collars 80 which are suitably affixed to the adjustable upper portions 50 and 52. The recesses 74 are located to hold the supporting rods 66 and 68 in extended, supporting positions, as shown in FIGS. 3 and 5, when they are received on the pins 78. The recesses 76 are positioned to hold the supporting rods 66 and 68 in folded positions in the plane of the frame members 16 and 18, as shown in dotted lines in FIG. 5, when the salon station 10 is to be transported. A rod 82 extends between the collars 80 for additional stability.

Figure 6:
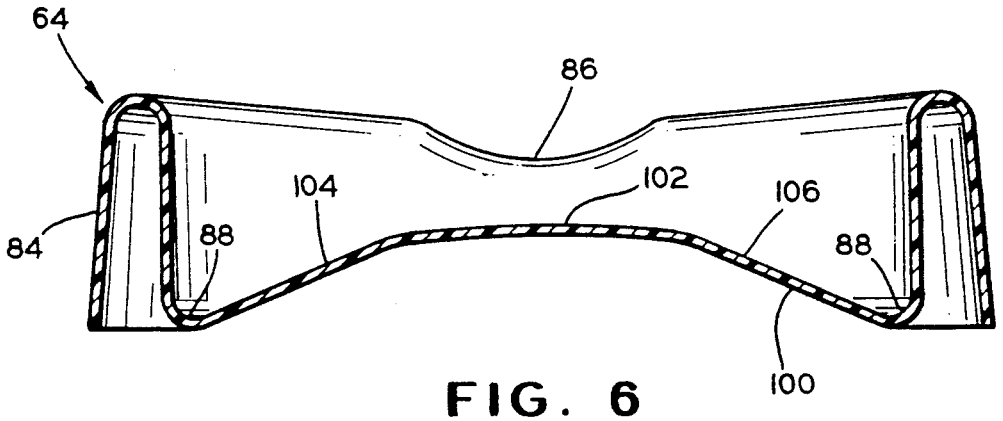
FIG. 6 is a longitudinal cross sectional view of the basin.
Figure 7:
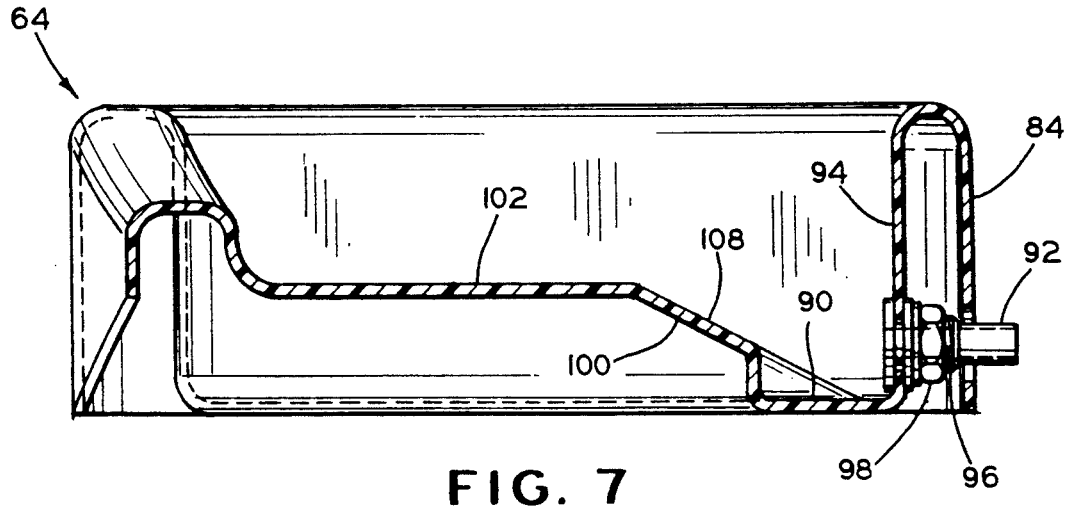
FIG. 7 is a view in transverse cross section of the basin of FIG. 6.

Referring particularly to FIGS. 6 and 7, the basin 64 can be vacuum formed of plastic material and is light in weight. It includes a double-wall wide rim 84 extending around all four sides and doubles back for strength. A shallow recess 86 is formed in the central, front portion of the rim to accommodate the neck of a patient. A trough 88 is located inside the rim 84 along the sides and back of the basin 64. The trough 88 communicates with a deeper recess 90 (FIG. 7) at a central rear portion of the basin. A nipple 92 extends beyond the back of the rim 84 and is suitably affixed to a front portion 94 of the rim by a fitting 96 and a nut 98. The nipple 92 can also be cemented into place. In any event, the nipple 92 communicates with the recess 92 to drain water therefrom.

A central portion of a bottom 100 of the basin is convex as indicated at 102 and slopes down to the trough 88 on the sides and back, having sloping portions 104, 106, and 108. This configuration of the bottom with the convex central portion 102 is important because it enables the head of the patient to be supported thereon so as to be more restful and avoid neck strain. Water can drain down the slopes 104–108 to the trough 88 and the recess 90 from which it can be drained through the nipple 92.

The basin 64 is removably supported on the rods 66 and 68 by tubes 110 (FIGS. 3 and 4) which extend between the double side walls of the side rim 84 and are suitably affixed therein at the fifteen degree angle, as by cementing. When the basin 64 is removed from the rods, it can be placed on a bed near the cart 12 so that the hair of a person who is bedridden can be shampooed. Thus, the mobile salon stand 10 is versatile for shampooing the hair of a variety of homebound people.

Water from the basin 64 drains through the nipple 92 to which a drain hose 112 (FIG. 2) is connected. The drain hose 112 extends into the top of a used water container or tank 114 which is located on the lower shelf 28. A clean water container or tank 116 is supported in side-by-side relationship with the used water tank 114 on the shelf 28. Prior to the shampooing operation, the container 116 is supplied with water at a suitable temperature from a faucet through a filling hose (not shown) having a funnel. By way of illustration, each of the tanks 114 and 116 can have a capacity of 4.5 gallons which has been found to be ample for most shampooing, etc. needs.

Water can be supplied from a supply hose 118 extending into the container 116 and communicating with a commercially-available pump 120 which is operated by a foot switch 122. Water is supplied from the pump 120 through a hose pump 124 to a suitable fitting 126 to which a spray head or other suitable device can be connected.

A supply case 128 (FIG. 1) can contain the various hoses, the pump, and the foot switch. It is located on the shelf 28 in front of the containers 114 and 116 when the station is transported. A supply case 130 can contain the usual supplies for shampooing, conditioning, and rinsing the hair along with a hair dryer. The case 130 is located on the forward portion of the shelf 44 in front of the vertical frame members 16 and 18. The basin 64 is supported on a rear portion of the shelf 44 after being removed from the supporting rods 66 and 68. At this time, the rods are pivoted to the folded condition of FIG. 5 so as to be located between the basin 64 and the case 130. A strap 132 is located around the containers 114 and 116 and the case 128. A strap 134 is located around the basin 64 and the case 130. These can be made of Velcro (TM), for example.

Various modifications of the above-described embodiment of the invention will be apparent to those skilled in the art, and it is to be understood that such modifications can be made without departing from the scope of the invention, if they are within the spirit and the tenor of the accompanying claims.

I claim:

1. A salon station comprising two generally upright, parallel frame members means for rigidly connecting said frame members together, said frame members each having upper telescoping, vertically adjustable portions, two supporting rods, pivotal mounting means for mounting said rods on said telescoping, vertically adjustable portions of said frame members to enable said supporting rods to pivot between a position in which said rods are substantially parallel to a plane formed by said frame members and a position extending outwardly from said plane and to be in a substantially parallel relationship, and a basin having two tubular members positioned to removably receive said supporting rods when extending outwardly from said frame members so said basin is supported thereby.

2. A station according to claim 1 wherein said supporting rods slant upwardly from the horizontal.

3. A station according to claim 1 wherein said supporting rods extend upwardly at an angle in the order of fifteen degrees to the horizontal.

4. A station according to claim 1 wherein the bottom of said basin is convex, facing in an upward direction, in a central portion and forms a drainage trough around part of said convex portion.

5. A station according to claim 1 wherein said station further comprises a cart including said frame members and said rigid connecting means and further including two ground-engagable wheels rotatably mounted to said frame members and ground-engagable feet mounted to said cart and spaced from said wheels.

6. A mobile salon station comprising a cart defined by a frame including two generally upright, parallel frame members each having upper vertically adjustable portions, said frame having ground-engagable wheels rotatably carried by said frame and ground-engagable feet spaced from said wheels, at least one generally horizontal shelf supported by said frame, two supporting rods, means for pivotally mounting said supporting rods on said upper portions of said frame members for vertical adjustment, a basin, and means for removably supporting said basin on said supporting rods whereby said salon station can be used with the basin supported on said rods and vertically adjusted for a patient in a wheelchair or the like and said basin can be removed from said supporting rods and used on a bed for a bedridden patient.

7. A mobile station according to claim 6 wherein said supporting rods slant upwardly from the horizontal.

8. A mobile salon station according to claim 6 wherein the bottom of said basin is convex, facing in an upward direction, in a central portion.

9. A mobile salon station according to claim 6 wherein said mounting means includes means for holding each of said supporting rods in a position extending outwardly from the corresponding frame member and for holding each of said supporting rods in a folded condition generally parallel to a plane of said upright frame members.

10. A mobile salon station comprising a cart defined by a frame rotatably carrying spaced, ground-engagable wheels and ground-engagable feet spaced from said wheels, said frame having two parallel generally upright frame members connected by a lower shelf, a container for used water and a container for clean water supported on said lower shelf, a basin, means for supporting said basin on said frame members, said supporting means comprising supporting rods pivotally mounted on said upright frame members, said supporting rods slanting upwardly from the horizontal, and means carried by said basin for removably receiving said supporting rods so as to be supported thereby.

11. A mobile station according to claim 10 wherein said supporting rods are pivotally mounted by pivotal mounting means employed to mount said supporting rods on said frame members for movement between extended, supporting positions and folded positions in a plane of said upright frame members.

12. A mobile station according to claim 10 wherein the bottom of said basin is convex, facing in an upward direction, in a central portion.

13. A mobile station according to claim 10 wherein said upright frame members have telescoping, vertically adjustable portions on which said supporting rods are pivotally mounted.

* * * * *